US007175523B2

(12) United States Patent
Gilmore et al.

(10) Patent No.: US 7,175,523 B2
(45) **Date of Patent: *Feb. 13, 2007**

(54) GAMING MACHINE WITH CHAIN REACTION SELECTION FEATURE

(75) Inventors: Jason C. Gilmore, Bartlett, IL (US); Larry J. Pacey, Prospect Heights, IL (US)

(73) Assignee: WMS Gaming Inc., Waukegan, IL (US)

( * ) Notice: Subject to any disclaimer, the term of this patent is extended or adjusted under 35 U.S.C. 154(b) by 409 days.

This patent is subject to a terminal disclaimer.

(21) Appl. No.: 10/042,620

(22) Filed: Jan. 9, 2002

(65) Prior Publication Data

US 2003/0130025 A1 Jul. 10, 2003

(51) Int. Cl.
*A63F 9/24* (2006.01)

(52) U.S. Cl. ..... 463/16

(58) Field of Classification Search ..... 463/16, 463/18–20; 273/138.1, 139, 143 R, 292
See application file for complete search history.

(56) References Cited

U.S. PATENT DOCUMENTS

| | | | | |
|---|---|---|---|---|
| 5,976,016 | A * | 11/1999 | Moody et al. | 463/20 |
| 6,033,307 | A * | 3/2000 | Vancura | 463/20 |
| 6,089,976 | A * | 7/2000 | Schneider et al. | 463/16 |
| 6,592,457 | B1 * | 7/2003 | Frohm et al. | 463/16 |
| 6,755,737 | B2 * | 6/2004 | Jackson et al. | 463/16 |

* cited by examiner

*Primary Examiner*—Mark Sager
*Assistant Examiner*—Robert Mosser
(74) *Attorney, Agent, or Firm*—Jenkens & Gilchrist

(57) ABSTRACT

A gaming machine and a method of conducting a game of chance on the gaming machine are disclosed. In response to a wager from a player, the machine conducts a selection game including a plurality of selectable elements associated with respective outcomes. In response to a player's selection of one of the selectable elements, the machine awards the outcomes associated with the selected element and at least one of the non-selected elements. The awarded outcome may, for example, include a payoff, a bonus game, or awarding the outcome associated with yet another of the non-selected elements. If the awarded outcome includes the bonus game, the bonus game may re-trigger the selection game.

24 Claims, 8 Drawing Sheets

GAMING MACHINE WITH CHAIN REACTION SELECTION FEATURE

FIELD OF THE INVENTION

The present invention relates generally to gaming machines and, more particularly, to a gaming machine that conducts a selection game in which a player's selection triggers a chain reaction of events.

BACKGROUND OF THE INVENTION

Gaming machines have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator.

Video gaming machines are typically operable to play such traditional games as video slots, poker, bingo, keno, and blackjack. Such games have been enhanced in recent years to include first and second screen bonus features. Due to the proliferation of such bonus features and the repeated use of similar (or even identical) bonus features in different games, many of the enhanced games now appear to be ordinary and mundane. Accordingly, in the competitive gaming machine industry, there is a continuing need for gaming machine manufacturers to produce new types of games, or enhancements to existing games, which will attract frequent play by enhancing the entertainment value and excitement associated with the game.

SUMMARY OF THE INVENTION

These and other objects are realized by a gaming machine and a method of conducting a game of chance on the gaming machine. In response to a wager from a player, the machine conducts a selection game including a plurality of selectable elements associated with respective outcomes. In response to a player's selection of one of the selectable elements, the machine awards the outcomes associated with the selected element and at least one of the non-selected elements. The awarded outcome may, for example, include a payoff, a bonus game, or awarding the outcome associated with yet another of the non-selected elements. If the awarded outcome includes the bonus game, the bonus game may re-trigger the selection game.

BRIEF DESCRIPTION OF THE DRAWINGS

The foregoing and other advantages of the invention will become apparent upon reading the following detailed description and upon reference to the drawings.

Figure 1:
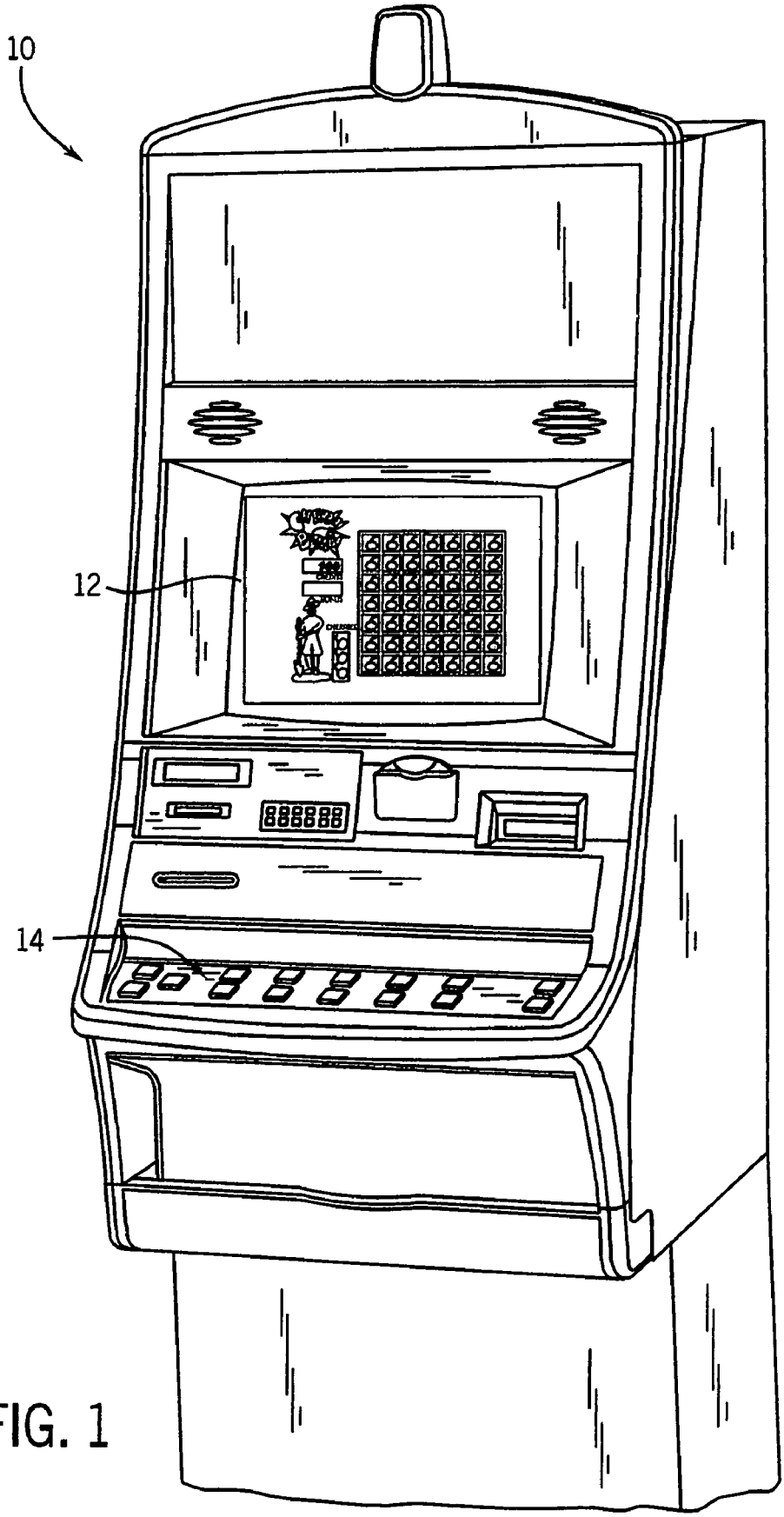
FIG. 1 is an isometric view of a gaming machine embodying the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Turning now to the drawings and referring initially to FIG. 1, a gaming machine 10 is operable to conduct a game of chance called Cherry Bomb having an exploding fruit theme. The Cherry Bomb game includes a primary interactive selection game and at least one bonus game triggered by the selection game. The bonus game, in turn, may re-trigger the selection game. The selection game includes an array of selectable elements. In response to a player's selection of one of the elements, a cherry is placed on the selected element. The cherry then explodes to trigger a chain reaction of events described in greater detail below.

The gaming machine 10 includes a video display 12 preferably in the form of a dot matrix, CRT, LED, LCD, electro-luminescent, or other type of video display known in the art. The video display 12 is preferably outfitted with a touch screen to facilitate interaction with the player. In the illustrated embodiment, the gaming machine 10 is an "upright" version in which the display 12 is oriented vertically relative to the player. Alternatively, the gaming machine may be a "slant-top" version in which the display 12 is slanted at about a thirty-degree angle toward the player of the gaming machine 10.

Figure 2:
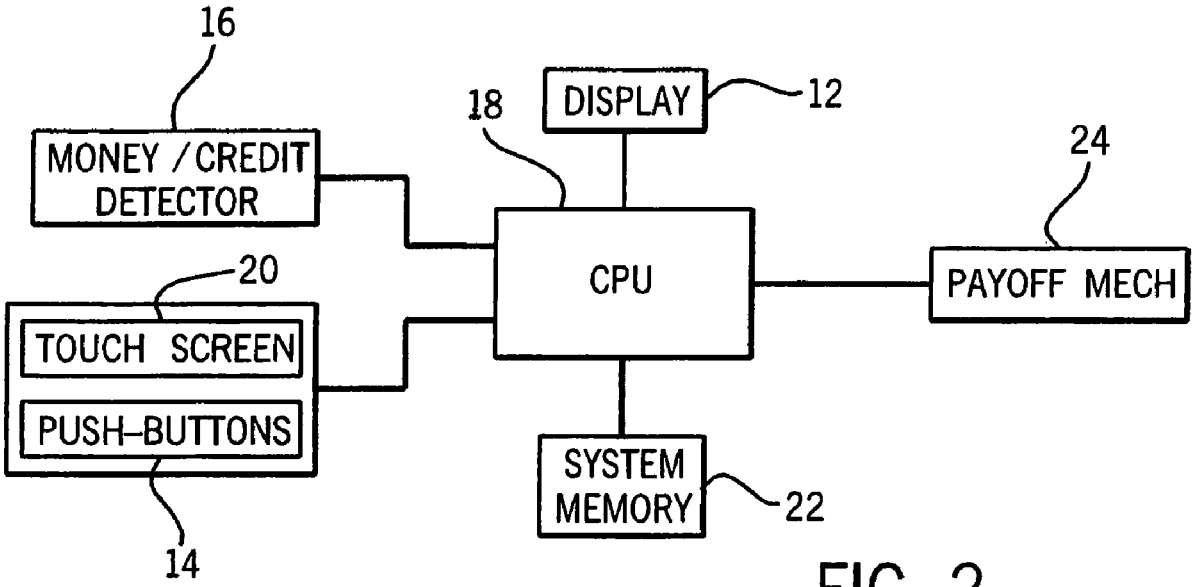
FIG. 2 is a block diagram of a control system suitable for operating the gaming machine.

FIG. 2 is a block diagram of a control system suitable for operating the gaming machine 10. Money/credit detector 16 signals a central processing unit ("CPU") 18 when a player has inserted money or played a number of credits. The money may be provided by coins, bills, tickets, coupons, cards, etc. The player may select a number of credits to wager and commence game play via the touch screen 20 or push-buttons 14. The CPU 18 executes a game program that causes the video display 12 to initially portray an array of selectable elements. In response to the wager, the CPU 18 randomly associates outcomes with the respective elements and prompts the player to select an element in a highlighted subset of the array. In response to the player's selection, the CPU 18 awards the outcomes associated with the selected element and at least one of the non-selected elements. The awarded outcome may, for example, include a payoff, a bonus game, or awarding the outcome associated with yet another of the non-selected elements. If the awarded outcome includes a bonus game, the bonus game may re-trigger the selection game.

A system memory 22 stores control software, operational instructions and data associated with the gaming machine 10. In one embodiment, the system memory 22 comprises a separate read-only memory (ROM) and battery-backed random-access memory (RAM). However, it will be appreciated that the system memory 22 may be implemented on any of several alternative types of memory structures or may be implemented on a single memory structure. A payoff mechanism 24 is operable in response to instructions from the CPU 18 to award a payoff to the player in response to any outcomes that include a payoff. The payoff may, for example, be in the form of a number of credits. The number of credits are determined by one or more math tables stored in the system memory 22.

Figure 3:
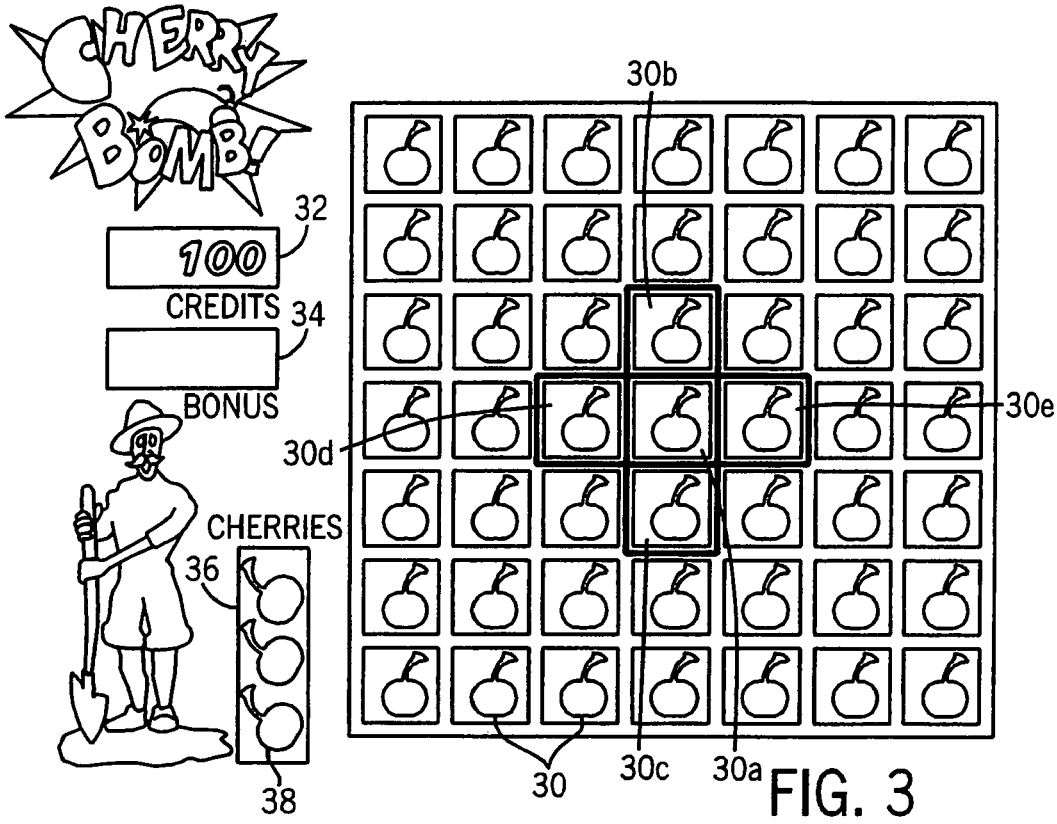
FIGS. 3 through 11 are display screen captures associated with the gaming machine.

Referring to FIG. 3, the Cherry Bomb game includes a primary interactive selection game and at least one bonus game that can be triggered by the selection game. The display 12 depicts a plurality of selectable elements 30 (e.g., "tiles") arranged in a rectangular array including a plurality of rows and columns. The plurality of selectable elements 30 are associated with respective outcomes. In addition, the display 12 depicts a credit meter 32, a bonus meter 34, and a cherry meter 36. The credit meter 32 shows the number of play credits loaded onto the gaming machine. The bonus meter 34 shows the number of credits won during a current play. The cherry meter 36 shows the number of cherries 38 purchased by a player with his/her wager. The player may wager up to three credits per play, and each credit is worth one cherry 38. Each cherry 38 permits the player to select one of the elements in a subset of elements that are highlighted in the array.

In response to selecting a highlighted element, a cherry 38 jumps from the cherry meter 36 to the selected element and explodes to trigger a chain reaction of events. Specifically, the cherry 38 explodes in a pattern encompassing the selected element and one or more non-selected elements in the array. The machine awards and reveals the outcomes associated with all of the elements in the explosion pattern of the cherry 38. The outcomes may, for example, include no payoff, a payoff, another exploding fruit, and a bonus game. The bonus game may include a different type of game, such as slots, poker, bingo, keno, roulette, or blackjack, having a different play mechanic than the selection game. The bonus game may, in turn, generate an outcome that re-triggers the selection game by randomly placing another exploding fruit on one of the elements 30 in the array. The fruit, which may be an extra cherry 38 or a different fruit, explodes in a pattern associated with that fruit. The machine again awards and reveals the outcomes associated with all of the elements in the explosion pattern of the fruit. When the chain reaction of events is over, if the player has any cherries 38 remaining in the cherry meter 36 the player repeats the process of selecting a highlighted element 30 to trigger a chain reaction of events.

An example of the chain reaction of events that can result from a single cherry placement is described below.

Referring to FIG. 3, to commence play of the selection game, a player places a wager of up to three credits. In FIG. 3, the player has wagered three credits because the cherry meter 36 shows three cherries 38. The machine then prompts the player to select one of the highlighted elements using the touch screen. The highlighted elements are preferably a subset of the array and may form a symmetrical cross pattern around a center element 30*a* of the array as shown in FIG. 3. In FIG. 3, the highlighted elements include the center element 30*a*, a pair of elements 30*b* and 30*c* vertically adjacent to the center element 30*a*, and a pair of elements 30*d* and 30*e* horizontally adjacent to the center element 30*a*.

Figure 4:
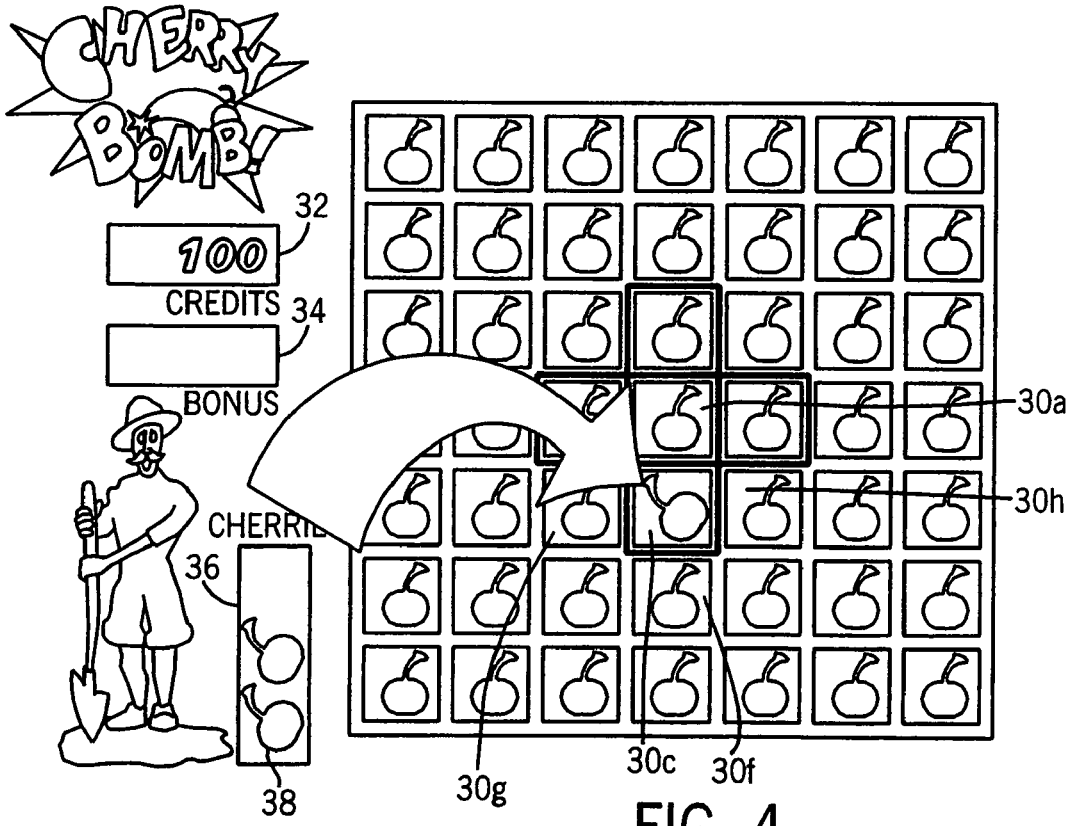
Figure 5:
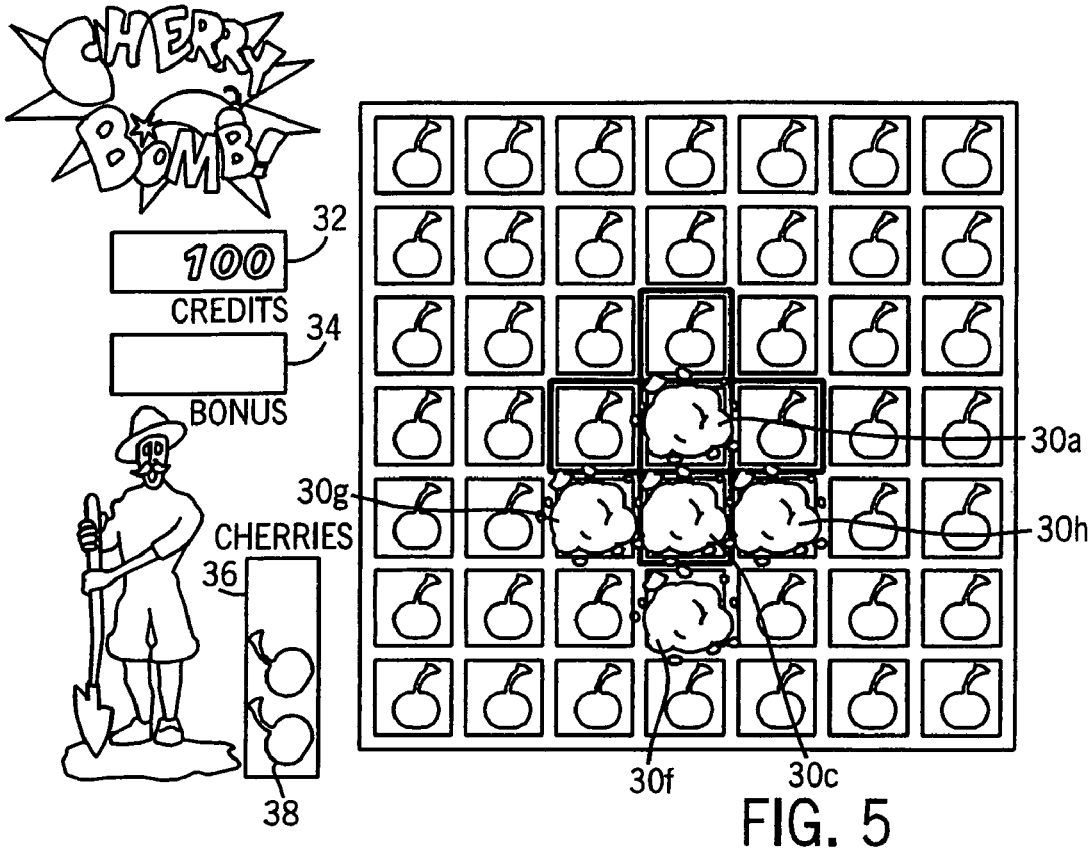

Referring to FIGS. 4 and 5, in response to the player's selection of the highlighted element 30*c*, a cherry 38 jumps from the cherry meter 36 to that element, pauses for a moment, and then explodes. The exploded cherry leaves a cloud of smoke over the selected element 30*c* and the four non-selected elements that are vertically and horizontally adjacent to the selected element (e.g., the "cross" elements 30*a*, 30*f*, 30*g*, and 30*h*).

Figure 6:
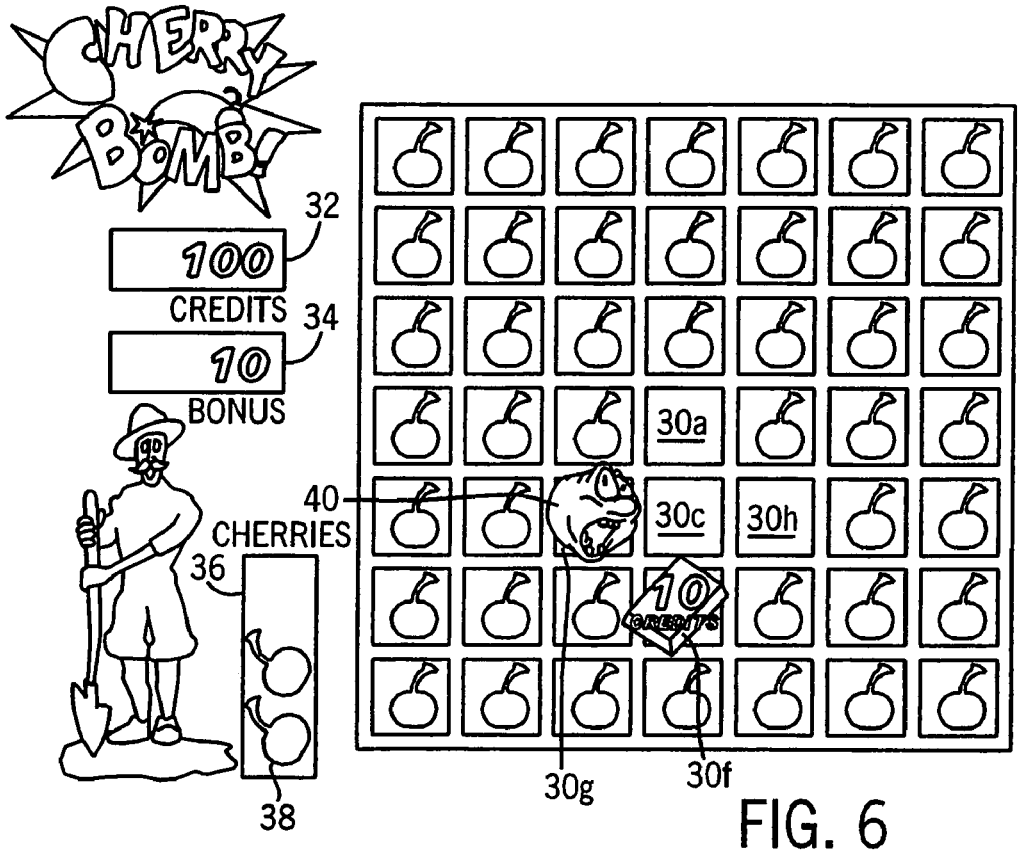

Referring to FIG. 6, the machine awards and reveals the outcomes associated with the directly selected element 30*c* and the four adjacent cross elements 30*a*, 30*f*, 30*g*, and 30*h* that were not directly selected by the player. In the illustrated example, the outcomes for the elements 30*a*, 30*c*, and 30*h* are no payoff, the outcome for the element 30*f* is a payoff of 10 credits that is added to the bonus meter 34; and the outcome for the element 30*g* is another fruit 40 such as an orange.

Figure 7:
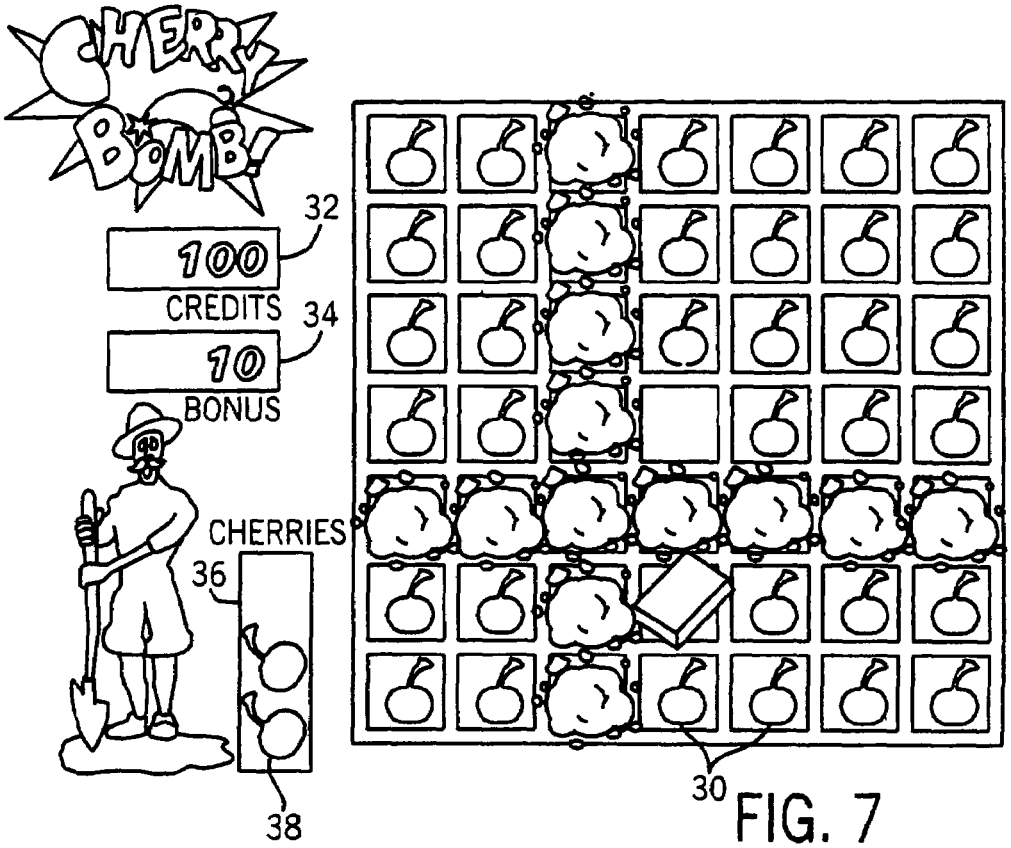

The orange 40 may remain inert and therefore be equivalent to no payoff. Alternatively, referring to FIG. 7, the orange 40 may explode to trigger a chain reaction in which the machine awards the outcomes associated with any elements 30 in the explosion pattern of the exploding orange 40. Here, the orange 40 explodes in a cross pattern extending to the boundaries of the array. The exploded orange 40 leaves a cloud of smoke over all of the elements 30 in the explosion pattern. Each type of fruit symbol preferably has a different explosion pattern. For example, as noted above, a cherry 38 explodes in a limited cross pattern including a center element and four adjacent cross elements. The orange 40 explodes in a larger cross pattern including a center element and an entire row and column of elements containing the center element.

Figure 8:
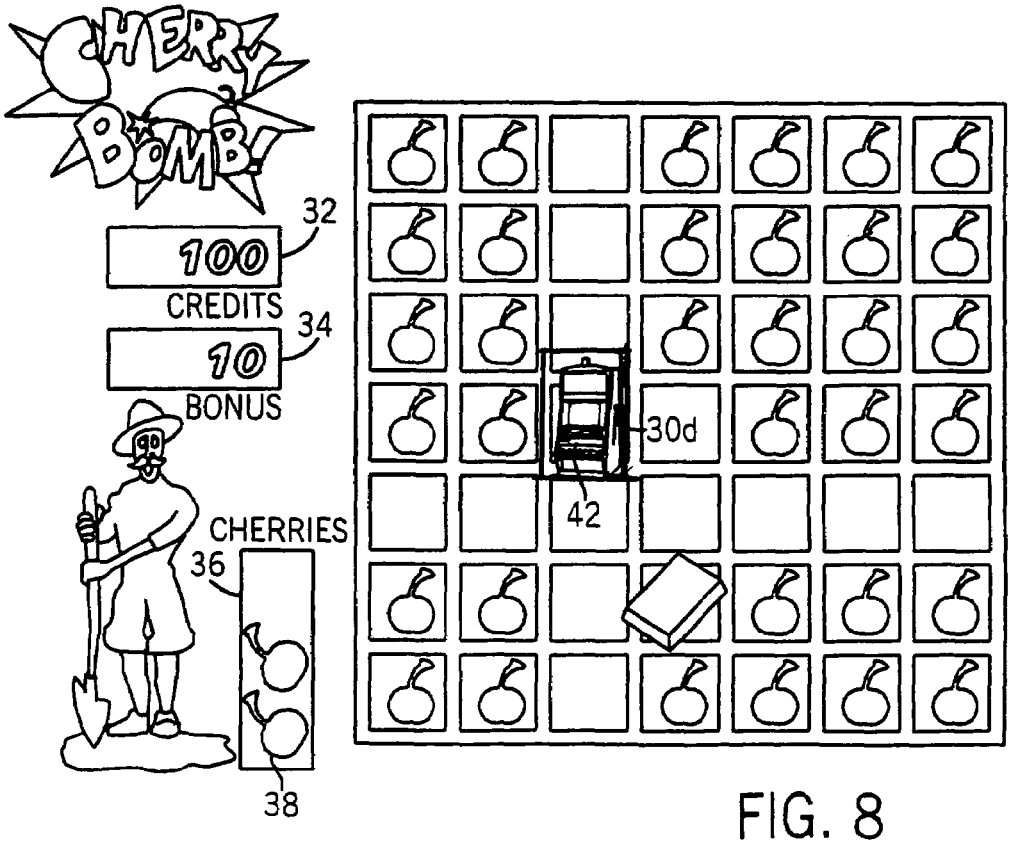

Referring to FIG. 8, the machine awards and reveals the outcomes associated with the elements 30 within the explosion pattern of the orange 40. None of these elements 30 were directly selected by the player at the commencement of the selection game, but the machine nonetheless awards and reveals the outcomes associated with such elements 30. Here, the outcome for the element 30*d* is a bonus game. As denoted by the slot machine symbol 42, the bonus game is a slot reel game. Specifically, the player is awarded a predetermined number of free spins in the slot reel game. Other bonus games denoted by other start-bonus symbols in the selection game are possible as well, such as poker, bingo, keno, roulette, and blackjack.

Figure 9:
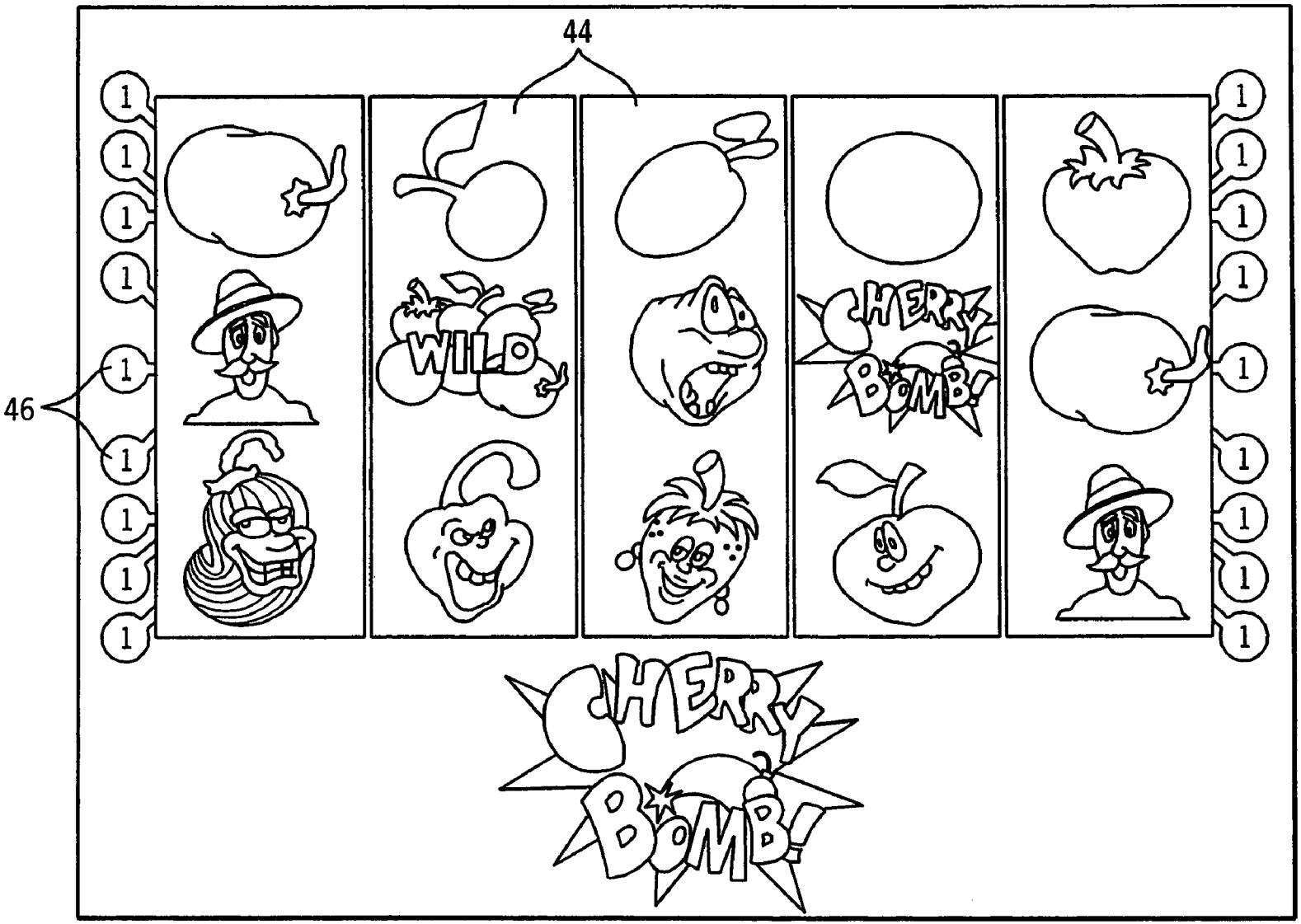

Referring to FIG. 9, the slot reel game is preferably shown on a secondary video display similar to the main video display 12 in FIG. 1. The secondary video display may be mounted in a top box portion of the machine housing. Alternatively, the slot reel game may be shown on the main video display 12, in which case the image of the selection game is temporarily replaced with an image of the slot reel game during the free spins. The slot reel game includes a plurality of symbol-bearing slot reels 44 that are rotated and stopped to place symbols on the reels 44 in visual association with one or more pay lines 46. In the illustrated example, the slot reel game include ten free spins of five slot reels 44 relative to nine pay lines 46, but more or less than ten free spins, five slot reels, and nine pay lines may be employed. For each free spin, the machine randomly selects a game outcome and then stops the reels to display symbols corresponding to the pre-selected game outcome. The game outcome includes a payoff if the combination of symbols along any pay line corresponds to one of the paying combinations identified by a pay table in system memory. A paying combination may, for example, be three or more matching symbols along any pay line. The payoffs for any paying combinations during the free spins are added to the bonus meter 34.

Figure 10:
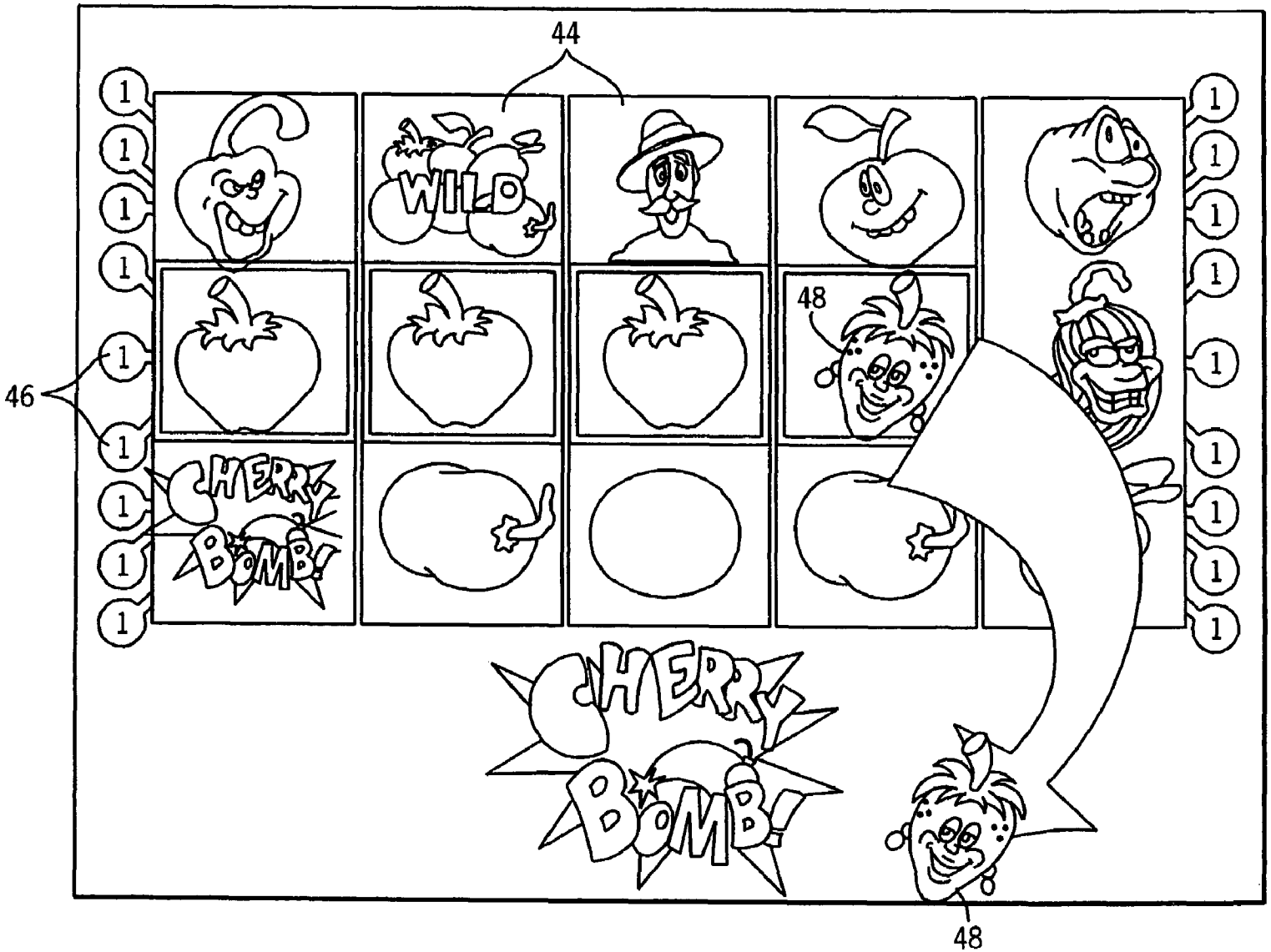
Figure 11:
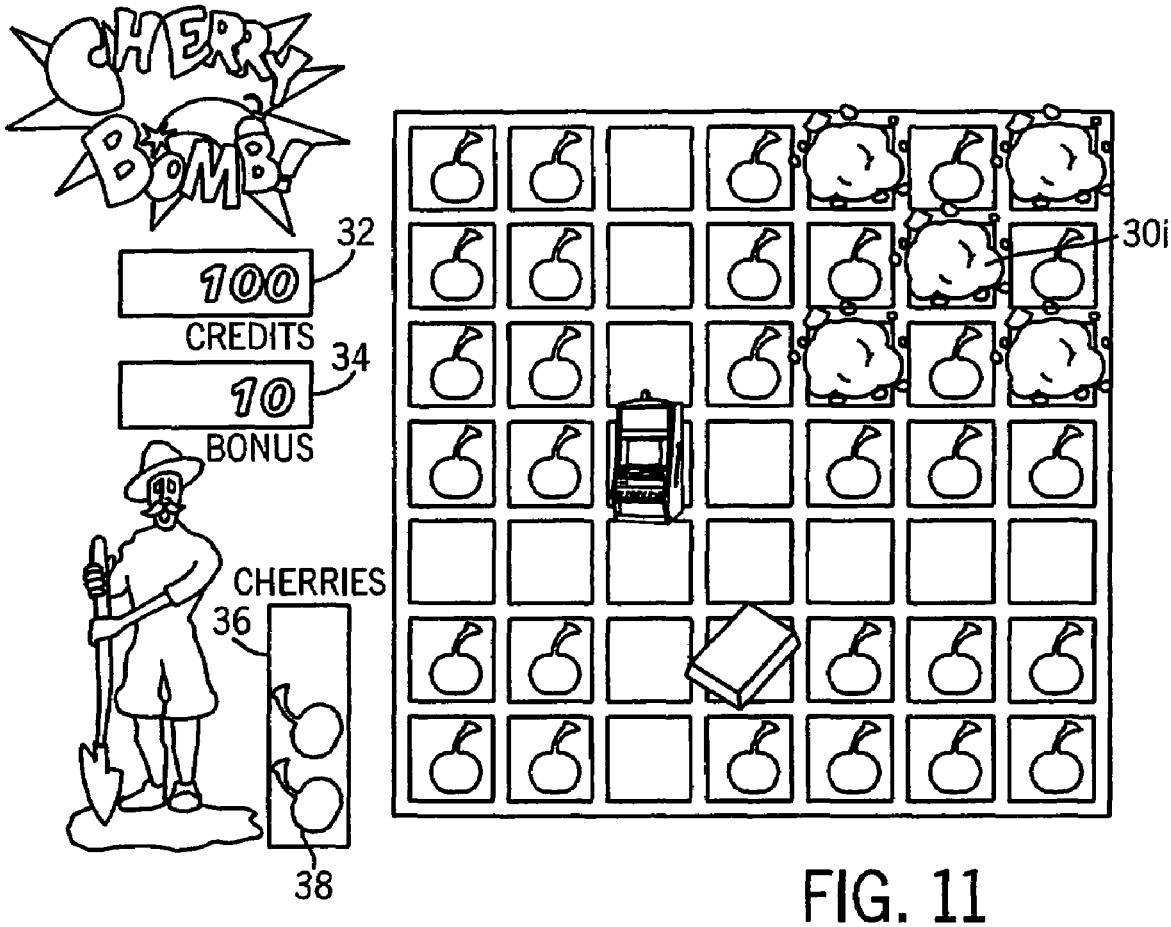

Referring to FIG. 10, the bonus game may re-trigger the primary interactive selection game. In the illustrated example, during the free spins of the slot reel game a combination of three matching fruit symbols and a character fruit symbol 48 along a pay line re-triggers the selection game. Here, the character fruit symbol 48 is a strawberry. The strawberry 48 jumps off of its reel symbol position. As shown in FIG. 11, the strawberry 48 randomly lands on an element 30*i* near the upper right corner of the array and explodes in a limited diagonal cross pattern associated with the strawberry. The exploded strawberry 48 leaves a cloud of smoke over all of the elements in the explosion pattern. The machine awards and reveals the outcomes (not shown) associated with the elements within the explosion pattern of the strawberry 48.

Once the chain of events and outcomes associated with the first placed cherry 38 from the cherry meter 36 have been completed, the above process of selecting one of the highlighted elements 30 in the array to trigger a chain of events is repeated for each cherry 38 remaining in the cherry meter 36.

While the present invention has been described with reference to one or more particular embodiments, those skilled in the art will recognize that many changes may be made thereto without departing from the spirit and scope of the present invention.

For example, the number, pattern, and location of the selectable elements 30 that are highlighted, and therefore can be selected for cherry placement, may randomly vary between cherry placements and/or between wagers. In an alternative embodiment, the number, pattern, and location of highlighted elements 30 may vary between cherry placements but remain the same for the first cherry placement after any wager. In another alternative embodiment, the number, pattern, and location of highlighted elements 30 may be the same between cherry placements and between wagers. If all of the highlighted elements 30 are exploded prior to placing all of the cherries 38 contained in the cherry meter 36, the game may refresh the array or allow any unused cherries in the cherry meter 36 to be "cashed in" for a bonus. In yet another alternative embodiment, the game may allow the player to choose any unexploded element 30 in the array for placement of a cherry, instead of only highlighted elements. The game may highlight some of the elements merely to suggest an optimum course of action.

Instead of only purchasing cherries 38 for placement in the array, the game may be modified to allow the player to purchase other fruits associated with different explosion patterns. Fruits with larger explosion patterns encompassing more elements 30 may be more costly (i.e., cost more credits) than fruits with smaller explosion patterns.

The chain reaction of events triggered by an exploding fruit may extend to adjacent gaming machines linked to the gaming machine 10. For example, the exploding fruit may produce a "super" explosion pattern that spreads to the display of an adjacent machine currently in play. The explosion pattern may encompass one or more of the elements 30 on the display of the adjacent machine. The adjacent machine, in turn, awards and reveals the outcomes in the explosion pattern. Alternatively, the explosion pattern may be unassociated with the elements on the display of the adjacent machine, but when the smoke clears the adjacent machine may reveal a bonus payoff.

Themes other than an exploding fruit theme may be employed. For example, the cherries 38 may be replaced with vehicles (air or land), persons, animals, dynamite, or any other things that can create an animated pattern encompassing multiple elements after being placed on a directly selected element. The machine awards and reveals the outcomes associated with any elements in the animated pattern.

Each of these embodiments and obvious variations thereof is contemplated as falling within the spirit and scope of the claimed invention, which is set forth in the following claims:

What is claimed is:

1. A method of conducting a game of chance on a gaming machine, the method comprising:

receiving a wager from a player;

displaying a plurality of selectable elements, each one of the plurality of selectable elements being associated with a corresponding one of a plurality of respective outcomes;

receiving a selection from the player of one of the plurality of selectable elements; and in response to the selection, awarding to the player a first outcome associated with the selected element and a second outcome associated with one of the non-selected elements, the first outcome being distinct from the second outcome and revealing the first and second outcomes associated with the selected element and the at least one of the non-selected elements at their respective locations, and wherein each one of the plurality of selectable elements initially masks the corresponding one of a plurality of respective outcomes.

2. The method of claim 1, wherein the one of the non-selected elements for which the outcome is awarded is adjacent to the selected element.

3. A method of conducting a game of chance on a gaming machine, the method comprising:

receiving a wager from a player;

displaying a plurality of selectable elements, each one of the plurality of selectable elements being associated with a corresponding one of a plurality of respective outcomes;

receiving a selection from the player of one of the plurality of selectable elements;

in response to the selection, awarding to the player a first outcome associated with the selected element and a second outcome associated with one of the non-selected elements, the first outcome being distinct from the second outcome; and wherein at least one of the awarded first and second outcomes include a payoff.

4. A method of conducting a game of chance on a gaming machine, the method comprising:

receiving a wager from a player;

displaying a plurality of selectable elements, each one of the plurality of selectable elements being associated with a corresponding one of a plurality of respective outcomes;

receiving a selection from the player of one of the plurality of selectable elements;

in response to the selection, awarding to the player a first outcome associated with the selected element and a second outcome associated with one of the non-selected elements, the first outcome being distinct from the second outcome; and wherein at least one of the awarded first and second outcomes include a bonus game.

5. The method of claim 4, wherein the bonus game includes a plurality of symbol-bearing slot reels that are rotated and stopped to place symbols on the reels in visual association with a display area.

6. The method of claim 4, further including in response to a certain result in the bonus game, awarding a third outcome associated with another of the non-selected elements.

7. The method of claim 1, further including awarding a third outcome associated with another of the non-selected elements.

8. The method of claim 1, wherein the step of displaying a plurality of selectable elements includes arranging the selectable elements in a matrix including a plurality of rows and columns, and wherein the one of the non-selected elements for which the second outcome is awarded includes a non-selected element adjacent to the selected element.

9. The method of claim 1, further including in response to the selection, displaying an animated pattern encompassing the selected element and the at least one of the non-selected elements.

10. A gaming machine, comprising:

means for displaying a plurality of selectable elements, each one of the plurality of selectable elements being associated with a corresponding one of a plurality of respective outcomes;

means for receiving a selection from the player of one of the plurality of selectable elements;

means, responsive to the selection, for awarding to the player the outcome associated with the selected element and at least one other outcome associated with at least one of the non-selected elements, each one of the plurality of selectable elements initially masking the corresponding one of a plurality of respective outcomes; and means, responsive to the selection from the player, for revealing the outcome associated with the selected element and the other outcome associated with the at least one of the non-selected elements at their respective locations.

11. The machine of claim 10, wherein the at least one of the non-selected elements for which the other outcome is awarded is adjacent to the selected element.

12. A gaming machine, comprising:

means for displaying a plurality of selectable elements, each one of the plurality of selectable elements being associated with a corresponding one of a plurality of respective outcomes;

means for receiving a selection from the player of one of the plurality of selectable elements;

means, responsive to the selection, for awarding to the player the outcome associated with the selected element and at least one other outcome associated with at least one of the non-selected elements; and wherein at least one of the awarded outcomes include a payoff.

13. A gaming machine, comprising:

means for displaying a plurality of selectable elements, each one of the plurality of selectable elements being associated with a corresponding one of a plurality of respective outcomes;

means for receiving a selection from the player of one of the plurality of selectable elements;

means, responsive to the selection, for awarding to the player the outcome associated with the selected element and at least one other outcome associated with at least one of the non-selected elements; and wherein at least one of the awarded outcomes include a bonus game.

14. The machine of claim 13, wherein the bonus game includes a plurality of symbol-bearing slot reels that are rotated and stopped to place symbols on the reels in visual association with a display area.

15. The machine of claim 13, further including means, responsive to a certain result in the bonus game, for awarding the outcome associated with another of the non-selected elements.

16. The machine of claim 10, wherein the awarded outcomes include another outcome associated with another of the non-selected elements.

17. The machine of claim 10, wherein the plurality of selectable elements are arranged in a matrix including a plurality of rows and columns, and wherein the at least one of the non-selected elements for which the at least one other outcome is awarded includes a plurality of the non-selected elements adjacent to the selected element.

18. The machine of claim 10, further including means, responsive to the selection, for displaying an animated pattern encompassing the selected element and the at least one of the non-selected elements.

19. A method of conducting a game of chance on a gaming machine, the method comprising:

receiving a wager from a player;

displaying a plurality of selectable elements, each one of the plurality of selectable elements being associated with a corresponding one of a plurality of respective outcomes, each one of the plurality of selectable elements initially masking the corresponding one of a plurality of respective outcomes;

receiving a selection from the player of one of the plurality of selectable elements; and in response to the selection, awarding to the player the outcomes associated with the selected element and at least one of the non-selected elements and revealing the outcomes associated with the selected element and the at least one of the non-selected elements at their respective locations.

20. A gaming machine, comprising:

a display for displaying a plurality of selectable elements, each one of the plurality of selectable elements being associated with a corresponding one of a plurality of respective outcomes, each one of the plurality of selectable elements initially masks the corresponding one of a plurality of respective outcomes; and an input device for receiving a selection from the player of one of the plurality of selectable elements, and in response to the selection, (i) the player is awarded the outcomes associated with the selected element and at least one of the non-selected elements and (ii) the display reveals the outcomes associated with the selected element and the at least one of the non-selected elements at their respective locations.

21. The method of claim 1, wherein at least one of the awarded first and second outcomes include a payoff.

22. The method of claim 1, wherein at least one of the awarded first and second outcomes include a bonus game.

23. The machine of claim 10, wherein at least one of the awarded outcomes include a payoff.

24. The machine of claim 10, wherein at least one of the awarded outcomes include a bonus game.

* * * * *